United States Patent [19]

Lewis, Jr. et al.

[11] Patent Number: 5,007,112

[45] Date of Patent: Apr. 16, 1991

[54] PROTECTIVE COVERALLS WITH IMPROVED VENTILATION

[75] Inventors: Milton A. Lewis, Jr., Richmond, Va.; Jeffrey S. Mason, Covington, Ind.; Carson B. Swinford, Danville, Ill.; Timothy R. Wiseman, Sr., Richmond, Va.

[73] Assignee: E. I. Du Pont de Nemours and Company, Wilmington, Del.

[21] Appl. No.: 444,497

[22] Filed: Nov. 30, 1989

[51] Int. Cl.[5] ..... A41D 13/00; A41D 13/02

[52] U.S. Cl. ..... 2/79; 2/2; 2/51; 2/81; 2/DIG. 4

[58] Field of Search ..... 2/79, 2, 51, 81, DIG. 4

[56] References Cited

U.S. PATENT DOCUMENTS

| | | | |
|---|---|---|---|
| 2,327,979 | 9/1941 | Bailey | 2/97 |
| 2,500,084 | 7/1947 | Metzger | 2/97 |
| 2,994,089 | 4/1954 | Ferguson, Jr. et al. | 2/81 |
| 3,292,179 | 5/1964 | Iacono, Jr. et al. | 2/2 |
| 3,651,520 | 5/1970 | Jacob | 2/272 |
| 3,691,564 | 11/1970 | La Marre et al. | 2/2 |
| 3,706,102 | 3/1971 | Grenier | 2/84 |
| 3,744,534 | 7/1973 | Henry et al. | 2/81 |
| 3,793,646 | 11/1974 | Tempelhof | 2/227 |
| 4,004,297 | 1/1976 | Polack | 2/227 |
| 4,034,417 | 7/1977 | Ellis | 2/81 |
| 4,223,064 | 7/1980 | Ballif et al. | 2/81 |
| 4,507,806 | 4/1985 | Coombs | 2/81 |
| 4,722,099 | 2/1988 | Kratz | 2/79 |
| 4,843,646 | 4/1988 | Grilliot et al. | 2/69 |
| 4,890,336 | 1/1990 | Worton | 2/79 |
| 4,897,886 | 2/1990 | Grilliot et al. | 2/81 |

FOREIGN PATENT DOCUMENTS

| | | | |
|---|---|---|---|
| 2702407 | 7/1978 | Fed. Rep. of Germany | 2/DIG. 1 |
| 1166636 | 11/1958 | France | 2/DIG. 1 |
| 1399632 | 4/1965 | France | 2/97 |
| 2447157 | 8/1980 | France | 2/79 |
| 1240203 | 7/1971 | United Kingdom | 2/DIG. 1 |
| 1491947 | 11/1977 | United Kingdom | 2/DIG. 1 |

*Primary Examiner*—Werner H. Schroeder
*Assistant Examiner*—Gloria Hale

[57] ABSTRACT

An improved one-piece protective coveralls of the type affording a barrier and thermal protection against hot and/or corrosive liquids. The coveralls include a generally continuous outer shell of woven aramid fabric covered by a liquid impervious layer and a corresponding inner multilayer thermally insulating liner inside of the outer shell. The inner liner is fabricated from at least one layer of low density nonwoven fabric fastened to a woven fabric. The improved coveralls include an elongate underarm opening under each arm of the liner extending downwardly from the position of the wearer's armpit into and along the underside of the sleeve and downwardly into and along the side of the torso portion. An elongated leg inseam opening is provided on the underside of the torso portion of said liner fabric and which extends from position of the wearer's crotch downwardly into and along the inside of each leg. A stretchable, air permeable fabric is attached to said liner fabric and covers and defines the size and shape of said openings. The coveralls in accordance with the invention provide improved ventilation and greater freedom of movement is provided in said inner liner without substantially decreasing the protection provided by the coveralls.

8 Claims, 3 Drawing Sheets

PROTECTIVE COVERALLS WITH IMPROVED VENTILATION

BACKGROUND OF THE INVENTION

The present invention relates to garments for providing protection to the wearer in a hazardous environment and more particularly relates to protective coveralls for protection against hot and/or corrosive chemicals which have improved comfort and ventilation.

Various types of protective coveralls are known for use in protecting the wearer of the coveralls from hazards including hot and/or corrosive chemicals, flame, molten metals, steam and the like. One such type of coveralls used for protection against hot and/or corrosive chemicals includes a one-piece suit for the body, arms and legs and a separate, removable headgear is worn together with the one-piece suit. Protective gloves which are capable of providing generally the same protection as the suit are typically worn with the suit.

Coveralls of this type which have been found to be particularly effective in providing protection have a laminated construction with a generally continuous outer shell of woven aramid fabric covered by a liquid impervious layer which is a barrier to the liquids to be encountered. The coveralls also include an inner liner which increases the protection against high temperature conditions and which may also include additional barrier layers. A particularly effective type of liner has been found to be a multilayer thermally insulating liner fabricated from at least one layer of low density nonwoven fabric fastened to a woven fabric.

In such coveralls, it typically is difficult to provide necessary ventilation without adversely affecting protection afforded by the liquid impervious barrier layer in the coveralls. Consequently, a cooling air system which uses air supplied from a source of pressurized air is provided in the interior of the coveralls. However, even with a cooling air system, good air circulation is difficult to achieve and it is particularly difficult to ventilate the armpit and crotch areas.

SUMMARY OF THE INVENTION

The invention provides an improved one-piece protective coveralls of the type affording a barrier and thermal protection against hot and/or corrosive liquids. The coveralls include a generally continuous outer shell of woven aramid fabric covered by a liquid impervious layer and a corresponding inner multilayer thermally insulating liner inside of the outer shell. The inner liner is fabricated from at least one layer of low density nonwoven fabric fastened to a woven fabric. The improved coveralls include an elongate underarm opening under each arm of the liner extending downwardly from the position of the wearer's armpit into and along the underside of the sleeve and downwardly into and along the side of the torso portion. An elongate leg inseam opening is provided on the underside of the torso portion of the liner fabric and which extends from position of the wearer's crotch downwardly into and along the inside of each leg. A stretchable, air permeable fabric is attached to the liner fabric and covers and defines the size and shape of the openings. The coveralls in accordance with the invention provide improved ventilation and greater freedom of movement without substantially decreasing the protection provided by the coveralls.

BRIEF DESCRIPTION OF THE DRAWINGS

The invention and its advantages may be understood by reference to the following detailed description when read in conjunction with the accompanying drawings in which.

DETAILED DESCRIPTION

Figure 1:
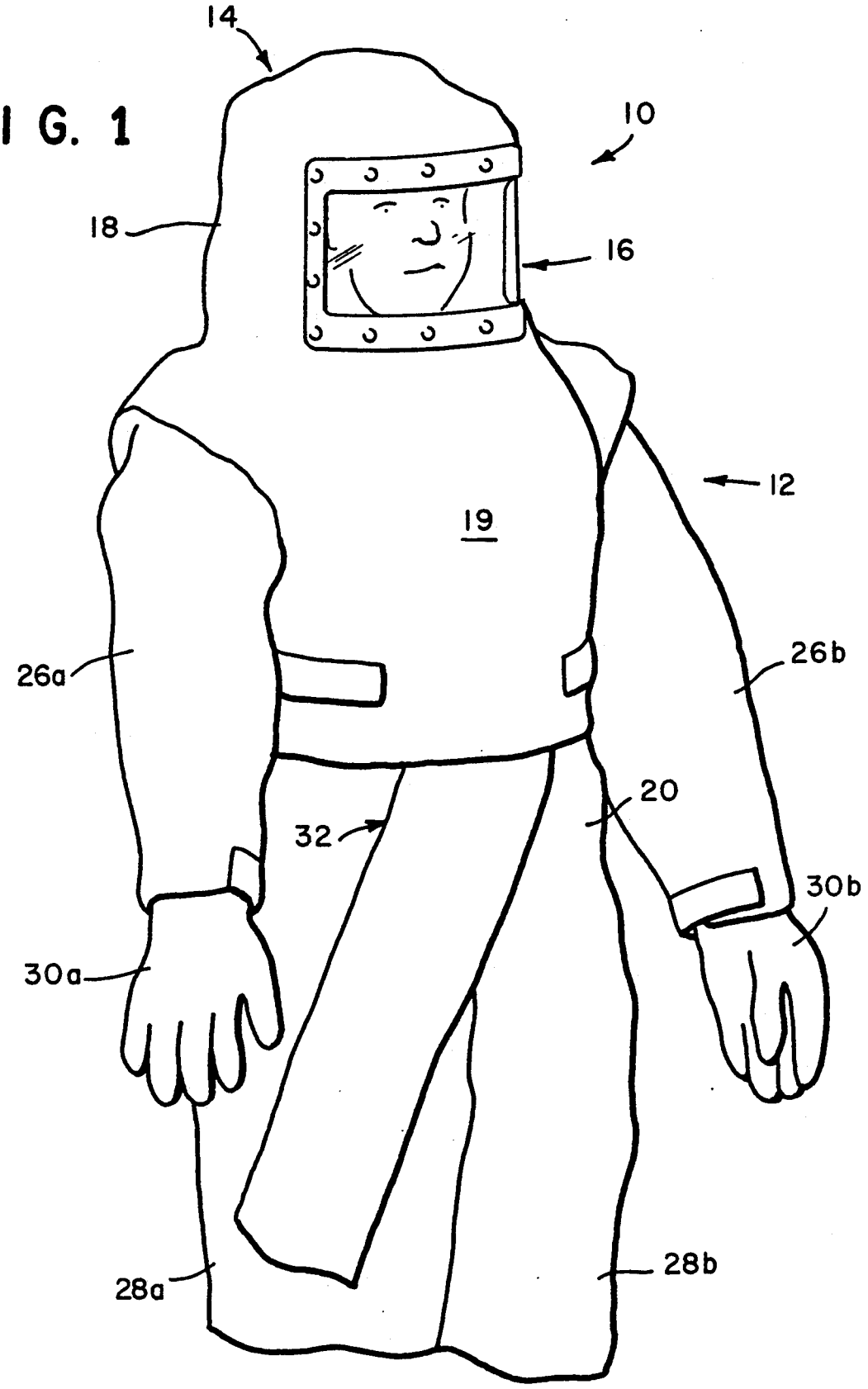
FIG. 1 is a somewhat diagrammatical perspective view of a preferred embodiment of coveralls in accordance with the present invention.

Referring now to the drawings in which like reference characters designate like and corresponding parts throughout the several views, there is shown in FIG. 1 protective coveralls 10 embodying a preferred form of the present invention. The protective coveralls include a one-piece main suit 12 and a removable headgear 14. The headgear 14 includes a viewing lens 16, a downwardly-draping hood 18 for covering the head of the wearer of the coveralls 10 and a hood bib 19 covering the upper areas of the main suit 12.

The coveralls 10 depicted are intended to represent coveralls which have a laminated construction intended to provide protection against hot and/or corrosive chemicals which include an outer shell fabric of woven aramid fabric covered by a liquid impervious layer and an inner multilayer thermally insulating liner fabric of at least one layer of low density nonwoven fabric fastened to a woven fabric. While not specifically intended for such purposes, coveralls of this type can offer protection against steam jets from a source with a pressure of less than about 150 psi. The outer shell-inner liner laminated construction is generally employed for most portions of the coveralls although the unlined shell may comprise portions of the suit which are not in direct contact with the body such as the hood bib 19. A preferred shell is constructed from a fabric woven from poly(paraphenylene terephthalamide) fiber which has been laminated to a liquid impervious layer, preferably, an aluminum film-poly(ethylene terephthalate) film laminate. A preferred multilayer liner includes at least a layer of woven poly(metaphenylene isophthalamide) and a nonwoven layer such as one or more layers of spun-laced fabrics of poly(paraphenylene terephthalamide). The layers are fastened together by suitable means such as by quilting. The inner liner may also include barrier layers.

Figure 2:
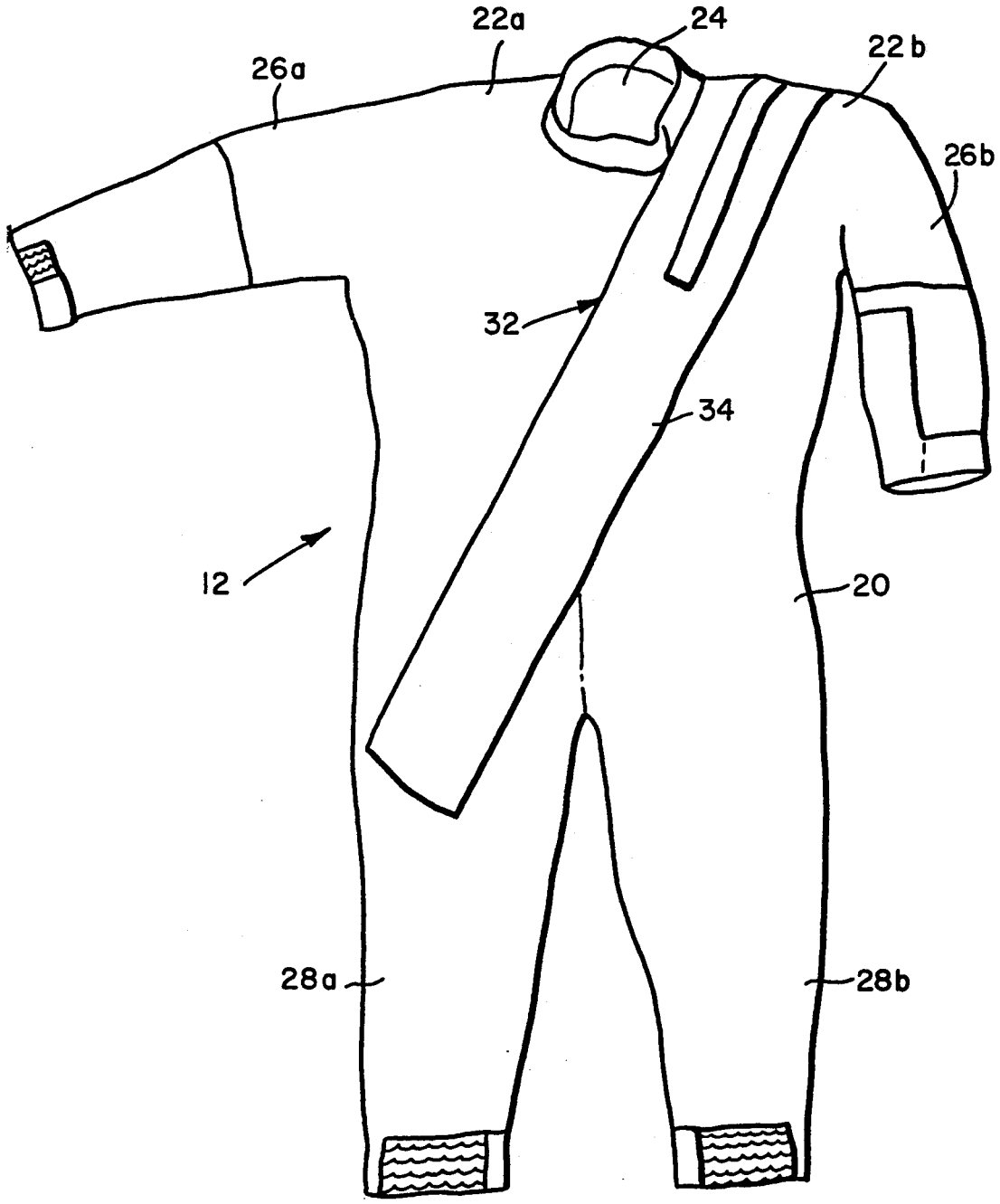
FIG. 2 is a somewhat diagrammatical perspective view of a main suit forming a portion of the coveralls illustrated in FIG. 1.

Referring to FIGS. 1 and 2, the main suit 12 of the coveralls includes a torso portion 20 including right and left shoulder areas, **22*a* and 22*b*, respectively, and a neck opening 24. Right and left arm and leg portions, 26*a* and 26*b*, respectively and 28*a* and 28*b*, respectively, are connected to the one piece main suit. Right and left gloves, 30*a* and 30*b***, respectively, are also provided.

Referring still to FIGS. 1 and 2, a main closure 32 is provided in the main suit 12 for providing access into the suit. The main closure 32 includes a slit-like opening (not shown) which, in the suit depicted, extends downwardly from the neck opening 24 adjacent the uppermost area of the left shoulder area **22*b* and which extends diagonally across the front of the torso portion 20 to a position adjacent the upper area opposite leg portion which is the right leg portion 28***a*. The slit-like opening is closable by a zipper (not shown) and is covered by an elongate flap 34. The elongate flap 34 is attached to the main suit 12 along and adjacent to the zipper at one side of the opening with the flap 34 to cover the zipper and provide an overlapping portion which overlaps the suit on the opposite side of the opening. The elongate flap 34 is made out of the same fabric as the main suit 12 and thus provides protection and prevents the entry of hazardous materials through the closure 32. The elongate flap 34 is permanently attached on one side of the opening such as by sewing but is removable from the opposite side since it is secured by means of complementary hook and loop fastening tapes such as those sold under the trademark VELCRO®.

Figure 3:
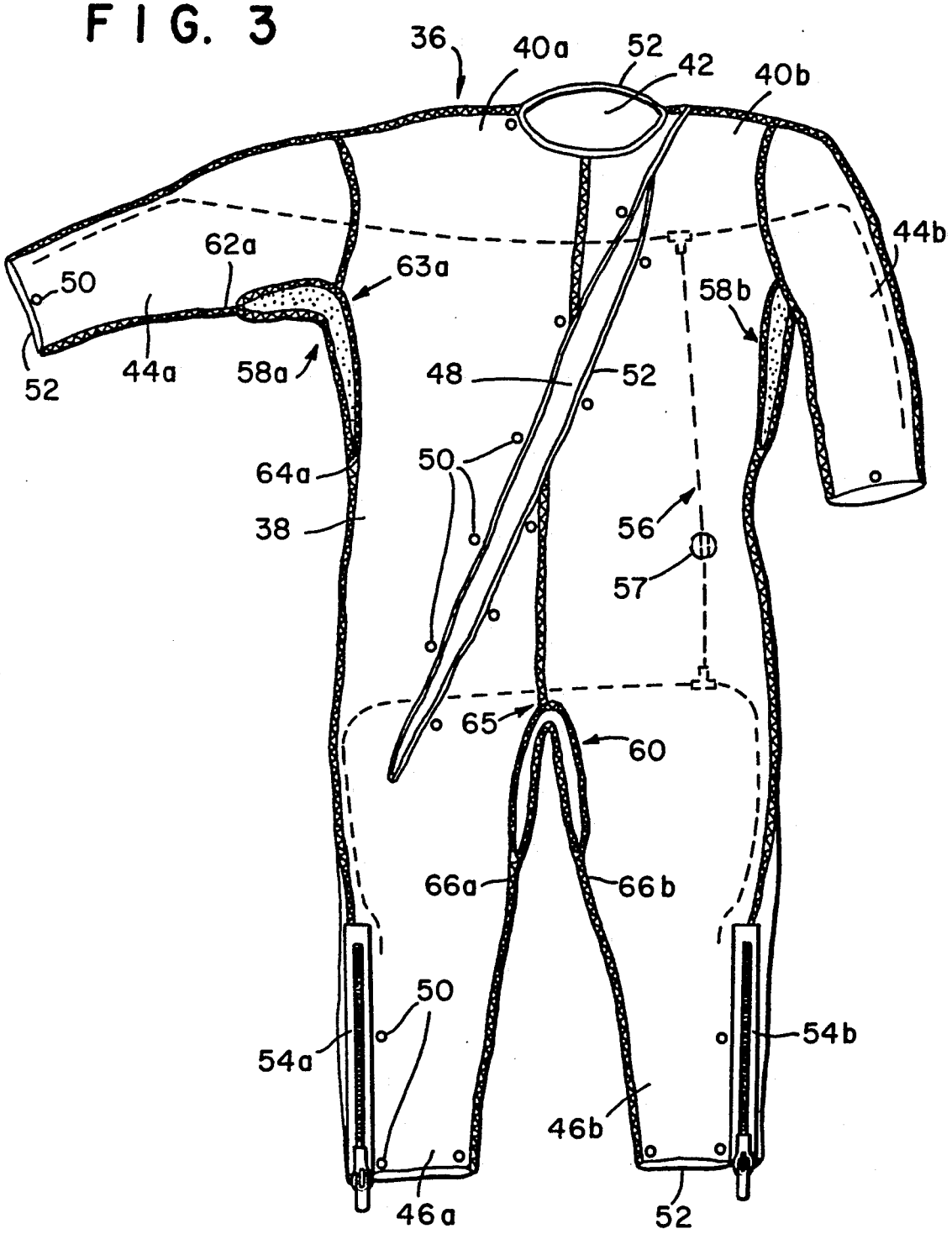
FIG. 3 is a somewhat diagrammatical perspective view of an inner liner of the coveralls illustrated in FIG. 1.

Referring now to FIG. 3, a preferred inner liner 36 for the main suit 12 in accordance with the present invention is shown. The inner liner 36 is fabricated from appropriately cut pieces of the multilayer laminated fabric suitably secured together such as by double-stitching with the seams to the exterior as indicated. The inner liner 36 has portions which correspond to the outer shell including a torso portion 38 and right and left shoulder areas, 40*a* and 40*b*, respectively, and a neck opening 42. Right and left sleeve and leg portions, 44*a* and 44*b*, respectively and 46*a* and 46*b*, respectively, further make up the inner liner 36. A slit-like opening 48 is provided in the front of the torso portion 38 which corresponds to the opening for the main closure 32. In the preferred embodiment illustrated, the liner 36 is secured by snaps 50 to the outer shell and is therefore removable from the outer shell such as for cleaning. Binding 52 is used at the neck opening 42, end of the sleeves and legs, and at the slit-like opening 48 to neatly secure the multiple layers of the liner fabric where no seam is otherwise present. Right and left zippers 54*a* and 54*b*, respectively, are provided at the lower areas of the legs to facilitate access into the coveralls in use.

A cooling air system 56 for the coveralls employing small diameter tubing connected with T's is indicated with dotted lines in FIG. 3. The tubing has a number of spaced-apart vent holes and is secured inside the liner by fasteners (not shown) and is connected to a fitting 57 which extends through the outer shell and inner liner of the coveralls. Air from a source (not shown) is used to supply the system 56 which distributes the air to the various portions of the inside of the inner liner 36.

In accordance with the invention, the inner liner 36 is provided with right and left underarm gussets 58*a* and 58*b*, respectively, and leg inseam gusset 60 which provide additional ventilation in the coveralls and provide additional comfort as will be explained in more detail hereinafter. Each of the gussets is formed by an opening which is covered with a stretchable, air permeable fabric which is attached to the periphery of the opening such as by sewing. A preferred stretchable, air permeable fabric is commercially-available stretchable nylon mesh such as that typically used for the manufacture of football jerseys. While the stretchable, air permeable fabric defines the size and shape of the opening, the shape of the openings is somewhat variable due to the stretching of fabric in use.

With the left underarm gusset 58*b* being understood to be correspond to the following description but on the left side, the right underarm gusset 58*a* is formed in an opening in the right underside arm seam 62*a* extending from the right armpit 63*a* into and along the underside of the right sleeve 44*a* and downwardly from the armpit 63*a* into and along the right side torso seam 64*a* at the right side of the torso portion 38. Preferably, each of the underarm gussets 58*a* and 58*b* has a combined length along the underside of its respective sleeve and along the side of the torso portion 38 of between about 12 and about 20 inches (about 38 cm and about 46 cm) and a width of between about 1 and about 2.5 inches (2.5 and about 6.5 cm). Toward their ends, the gussets preferably taper in width so that they merge smoothly into the seams adjoining the gussets. In addition, it is preferable for the gusset to extend downwardly and into the side torso seam a longer distance than down the underside of the sleeve. Most preferably, the underarm gussets 58*a* and 58*b* extend along the underside of each the sleeves by a distance of between about 4 inches and about 8 inches (about 10 cm and about 20 cm) and down the side of the torso portion by a distance of between about 6 inches and about 15 inches (about 15 cm and about 38 cm).

In the preferred embodiment depicted, the leg inseam gusset 60 is formed from an opening in the right and left inseams 66*a* and 66*b* from the position of the wearer's crotch 65. In addition, it is preferable for the stretchable, air permeable fabric of the leg inseam gusset to have a combined length along the inside of both legs of between about 12 and about 20 inches (about 38 cm and about 46 cm) and a width of between about 1 and about 2.5 inches (2.5 and about 6.5 cm). Toward its ends, the leg inseam gusset 60 preferably is tapered in width so that it merges smoothly into the inseams 66*a* and 66*b* adjoining the gusset.

The coveralls of the invention are used similarly to known coveralls of this type but improved ventilation and comfort results. The gussets provide a vent for air and moisture from the liner 36 which can provide for improved ventilation with the air supplied from a cooling system. Supplied air is readily vented from the gussets and is then vented from the coveralls by traveling between the space between the outer shell and inner liner to existing openings in the outer shell, e.g., at the neck opening which is covered by the hood. In addition, the gussets allow for expansion of the liner to prevent binding and provide for increased comfort and mobility to the wearer. Because no vents are made in the outer shell and because of the protected locations of the gussets, the liquid barrier protection of the coveralls is not affected and the thermal protection is not substantially decreased.

While a preferred embodiment has been shown and described in the foregoing detailed description, it will be understood that the invention is capable of numerous modifications, rearrangements and substitution of parts without departing from the spirit of the invention as set forth in the appended claims.

I claim:

1. Improved one-piece protective coveralls of the type affording a barrier and thermal protection against hot and/or corrosive liquids having a generally continuous outer shell of woven aramid fabric covered by a liquid impervious layer and an inner multilayer thermally insulating liner inside of said outer shell, said inner liner being fabricated from at least one layer of low density nonwoven fabric fastened to a woven fabric, said outer shell and inner liner having corresponding torso, sleeve and leg portions, wherein the improvement comprises:

an elongate underarm opening under each arm of said liner extending downwardly from the position of the wearer's armpit into and along the underside of the sleeve and downwardly into and along the side of the torso portion;

an elongate leg inseam opening on the underside of the torso portion of said liner fabric and extending from position of the wearer's crotch downwardly into and along the inside of each leg; and a stretchable, air permeable fabric attached to said liner fabric and covering and defining the size and shape of said openings;

whereby ventilation and greater freedom of movement is provided in said inner liner without substantially decreasing the protection provided by the coveralls.

2. The coveralls of claim 1 wherein said stretchable, air permeable fabric at each of said underarm openings has a combined length along the underside of said sleeve and along the side of the torso portion of between about 12 and about 20 inches (about 38 cm and about 46 cm) and a width of between about 1 and about 2.5 inches (2.5 and about 6.5 cm).

3. The coveralls of claim 2 wherein said underarm opening and said stretchable, air permeable fabric extends along the side of the torso portion a longer distance than down the underside of the sleeve.

4. The coveralls of claim 3 wherein said stretchable fabric extends along the underside of each said sleeves by a distance of about 4 inches to about 8 inches (about 10 cm and about 20 cm) and down the side of the torso portion by a distance of between about 6 inches and about 15 inches (about 15 cm and about 38 cm).

5. The coveralls of claim 1 wherein said stretchable, air permeable fabric and said leg inseam opening has a combined length along the inside of both legs of between about 12 and about 20 inches (about 38 cm and about 46 cm) and a width of between about 1 and about 2.5 inches (2.5 and about 6.5 cm).

6. The coveralls of claim 1 wherein the inner liner is fabricated of cut pieces of multilayer fabric which are secured together along their fabric seams by attaching means and wherein the underarm opening is formed between seams in the position of the wearer's armpit and the leg inseam opening is formed between seams in the position of the wearer's crotch.

7. The coveralls of claim 1 wherein said stretchable, air permeable fabric is stretchable nylon mesh.

8. The coveralls of claim 1 further comprising a supplied cooling air system for supplying cooling air to the interior of said liner.

* * * * *

UNITED STATES PATENT AND TRADEMARK OFFICE

CERTIFICATE OF CORRECTION

PATENT NO. : 5,007,112

DATED : April 16, 1991

INVENTOR(S) : Milton A. Lewis, Jr.; Jeffrey S. Mason; Carson B. Swinford; and Timothy R. Wiseman, Sr.

It is certified that error appears in the above-identified patent and that said Letters Patent is hereby corrected as shown below:

On the title page, next to the Assignee reference numeral [73], the assignee "E. I. Du Pont de Nemours and Company, Wilmington, Del." should read -- E. I. Du Pont de Nemours and Company, Wilmington, Del and Steel Grip, Inc., Danville, Ill.--

Signed and Sealed this

Twenty-ninth Day of September, 1992

*Attest:*

DOUGLAS B. COMER

*Attesting Officer*

*Acting Commissioner of Patents and Trademarks*